US007108645B2

(12) United States Patent
Lincoln

(10) Patent No.: US 7,108,645 B2
(45) Date of Patent: Sep. 19, 2006

(54) STRADDLE STRETCHING APPARATUS

(76) Inventor: Bret M. Lincoln, 57 Sadler St., Lynn, MA (US) 01905

( * ) Notice: Subject to any disclaimer, the term of this patent is extended or adjusted under 35 U.S.C. 154(b) by 0 days.

(21) Appl. No.: 10/804,961

(22) Filed: Mar. 19, 2004

(65) Prior Publication Data

US 2005/0209068 A1 Sep. 22, 2005

(51) Int. Cl.
*A63B 26/00* (2006.01)

(52) U.S. Cl. ..... 482/142; 482/907; 482/135

(58) Field of Classification Search ..... 482/142, 482/907, 92–95, 135; D21/676, 686, 690, D21/695

See application file for complete search history.

(56) References Cited

U.S. PATENT DOCUMENTS

| | | | | |
|---|---|---|---|---|
| 2,152,431 | A * | 3/1939 | Jensen | 606/245 |
| 4,445,684 | A | 5/1984 | Ruff | 272/134 |
| 4,531,730 | A * | 7/1985 | Chenera | 482/142 |
| 4,647,040 | A * | 3/1987 | Ehrenfried | 482/131 |
| 4,844,453 | A | 7/1989 | Hestilow | 272/126 |
| 4,892,304 | A | 1/1990 | DeNiro | 272/126 |
| 5,026,049 | A * | 6/1991 | Goodman | 482/131 |
| 5,137,504 | A | 8/1992 | Mangini | 482/131 |
| 5,507,711 | A * | 4/1996 | Richardson | 482/112 |
| 5,520,598 | A | 5/1996 | Little | 482/79 |
| 5,562,578 | A | 10/1996 | Guillemette | 482/100 |
| 5,800,323 | A | 9/1998 | Ansel | 482/129 |
| 5,904,641 | A | 5/1999 | Huang | 482/131 |
| 6,090,022 | A | 7/2000 | Colecchi | 482/131 |
| 6,352,495 | B1 | 3/2002 | Hsu | 482/92 |

* cited by examiner

*Primary Examiner*—Lori Amerson
(74) *Attorney, Agent, or Firm*—John H. Pearson, Jr., Esq.; Walter F. Dawson, Esq.; Pearson & Pearson, LLP

(57) ABSTRACT

A straddle stretching apparatus comprises a seat on top of a support frame and leg support wings which extend from opposite sides of the seat and move outward and upward away from the support frame as a handle at the top of the base is rotated. The handle attaches to rotating means which has struts extending from opposite sides that attach to the side of the leg support wings. The stretching apparatus is used to stretch the muscles of the lower and upper body including the legs, lower back and upper body. Stretch straps are provided on the side of the leg support wings to assist the user in a stretching exercise.

17 Claims, 4 Drawing Sheets

STRADDLE STRETCHING APPARATUS

BACKGROUND OF THE INVENTION

1. Field of the Invention

This invention generally relates to an exercise machine, and in particular to a leg stretching exercise apparatus having a padded seat with a rear cutout, padded leg support wings, a rotating handle for adjustment of the leg support wings, and provides a natural workout position for the user.

2. Description of Related Art

Stretch machines are used by athletes and non-athletes. Athletes typically participate in strenuous exercises and stretching relaxes muscles, prevents cramps and allows a person to loosen up prior to participating in a strenuous activity. Non-athletes include people who need to stretch for rehabilitation purposes or senior citizens who need to stretch due to circulation problems.

Many stretch machines in the prior art require the user to sit down on the floor and workout in an unnatural position. This often presents a problem for people that need to stretch for rehabilitation purposes or for senior citizens who need to stretch for circulation problems. The sit-down machine often limits the muscles that need to be stretched.

In the prior art, various approaches have been taken to provide a stretch machine. In U.S. Pat. No. 4,647,040, issued Mar. 3, 1987 to Ted R. Ehrenfried and assigned to Treco Products, Inc., a leg stretching apparatus is disclosed whereby an operator sits on a torso restraining means such as a seat assembly and a base assembly. The operator's legs are placed in the leg supporting means which are spread apart through the action of a crank and a pivoting of a crank assembly housing which includes a worm gear. However, this machine requires the user to sit down and it does not allow the user to stretch in a natural position.

In U.S. Pat. No. 5,507,711, issued Apr. 16, 1996 to Michael Richardson, a leg stretcher exercise machine is disclosed for sitting in an upright position having a centrally located padded seat and padded wings or leg platforms which are hingedly mounted on opposite sides of the seat with removable hinge pins for quick connect and disconnect from the seat. A hydraulic jack is mounted on the frame below the seat. A pump arm attached to the jack allows the user to raise the leg platforms, and a release valve control arm is provided for lowering the leg platforms. However, this exercise machine does not allow the stretcher to stretch in what is referred to as the hurdler's stretch.

In U.S. Pat. No. 4,844,453, issued Jul. 4, 1989 to Gary P. Hestilow, and assigned to Century Martial Art Supply, Inc., a stretching machine for stretching the legs of an individual is disclosed comprising a seat with an adjustable back and a pair of leg bars. The leg bars have a pivot end and an opposite a termination end. Each of the leg bars is connected to a hydraulic jack having a jack handle for moving the leg bars to stretch positions. A release rod deactivates the hydraulic jack to move the leg bars back to the rest position. Leg decks attach to the leg bars, and leg pads and thigh pads are provided. However, this stretching machine does not allow the user to stretch in what is referred to as the Chinese split or the hurdler's stretch.

In U.S. Pat. No. 5,520,598, issued May 28, 1996 to Oscar L. Little, a leg exercising machine having handlebars attached to a vertical support by means of a pin is disclosed. Mounted on the frame is a lower leg exercise device having a planar base member attached to the base frame, distal end plates, weight posts, two track assemblies with a wheeled platform extending horizontally from the base frame. A person standing with a foot on each platform slides the platforms back and forth along the track assemblies by alternately flexing and relaxing arms and outer muscles in the person's upper legs. A handle bar assembly is adjustably attached to the vertical support. This exercise machine requires the user to sit down, and it does not have any support for the user's body weight allowing a safe, comfortable stretch.

In U.S. Pat. No. 5,800,323, issued Sep. 1, 1998 to Cliff Ansel, an adjustable hip and thigh exercise apparatus 20 with padded handlebars is disclosed. The apparatus is attached to a wall and aligned with the pivot point of a user's hip. However, this exerciser has no seat.

Therefore, it is desirable to have a leg stretching exercise machine of minimum cost and high durability that allows the user to sit comfortably in an upright position and easily adjust leg supports to a stretching position.

SUMMARY OF THE INVENTION

Accordingly, it is therefore an object of this invention to provide a leg stretching exercise apparatus that helps a user stretch muscles of the upper back and lower back.

It is another object of this invention to provide leg stretching apparatus whereby the user sits comfortable on the apparatus in an upright position simulating the natural posture of a person standing.

It is another object of this invention to provide a handle whereby the user can easily turn the handle to raise the leg supports.

It is a further object of this invention to provide elastic bands on the leg supports to assist the user in performing stretch exercises.

It is another object of this invention to enable a user to perform basic stretch exercises to the most advanced exercises without using static and non-static movements.

These and other objects are accomplished by a leg stretching apparatus comprising a frame, the frame supporting a seat attached to the frame, a pair of leg supporting wings hingedly mounted on opposite sides of the seat, and means enclosed within the frame for raising and lowering the leg supporting wings in response to a turning of a lever of the raising and lowering means. The frame comprises a step for assisting a user climbing onto the apparatus. Each of the leg supporting wings comprises a wing support frame attached to a leg section. The frame comprises a hinge support bar positioned adjacent to the seat for receiving the pair of hingedly mounted leg supporting wings. The raising and lowering means comprises a universal joint attached to an upper end of a threaded rod. The lever attaches to an upper end of the universal joint for rotating the threaded rod. The frame comprises a wing drive housing having the universal joint attached to an upper end of the threaded rod enclosed therein. The threaded rod comprises a drive bar having a hex nut located in the center of the drive bar which screws on the threaded rod, and the drive bar further comprises a pair of drive extensions, each of the drive extensions being welded to opposite sides of the hex nut and extending through an opening in opposite sides of the wing drive housing. The frame comprises a crank housing, extending upwardly from the wing drive housing, for enclosing a crank rod attached to the lever. The apparatus comprises a first strut having a first end attached to a first end of the drive bar and a second end attached to a first one of the pair of leg supporting wings, and a second strut having a first end attached to a second end of the drive bar and a second end attached to a second one of the pair of leg supporting wings.

These and other objects are accomplished by a leg stretching apparatus comprising a frame, a seat attached to said frame, a pair of leg supporting wings hingedly mounted on opposite sides of said seat, a hinge support bar positioned adjacent to said seat for receiving said pair of hingedly mounted leg supporting wings, a threaded rod positioned within said frame having a universal joint attached to an upper end, a crank rod extended between said universal joint and a lever for turning said threaded rod, a pair of drive bars attached to opposite sides of a hex nut, said hex nut moving along said threaded rod as said threaded rod turns in response to a rotation of said lever to raise and lower said leg supporting wings, a first strut having a first end attached to a first end of said drive bar and a second end attached to a first one of said pair of leg supporting wings, and a second strut having a first end attached to a second end of said drive bar and a second end attached to a second one of said pair of leg support wings. The frame comprises a step for assisting a user climbing onto said apparatus. Each of said leg supporting wings comprises a wing support frame attached to a leg section. The leg section is slightly concave to retain a user's leg. Each of said leg support wings comprises a stretch strap to assist the user in a stretching exercise.

The objects are further accomplished by a method of providing a leg stretching apparatus comprising the steps of providing a frame, said frame supporting a seat attached to said frame, mounting on opposite sides of said seat a pivoting end of a pair of leg supporting wings, and enclosing within said frame means for raising and lowering said leg supporting wings in response to a turning of a lever attached to said raising and lowering means. The method includes the step of mounting said pair of leg supporting wings includes the step of attaching a leg support frame to a leg section. The method includes the step of providing a frame includes the step of providing a support bar positioned adjacent to said seat for receiving said pivoting end of said pair of leg supporting wings. The method includes the said step of enclosing within said frame means for raising and lowering said leg supporting wings includes the step of attaching a universal joint to an upper end of a threaded rod.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENT

Figure 1:
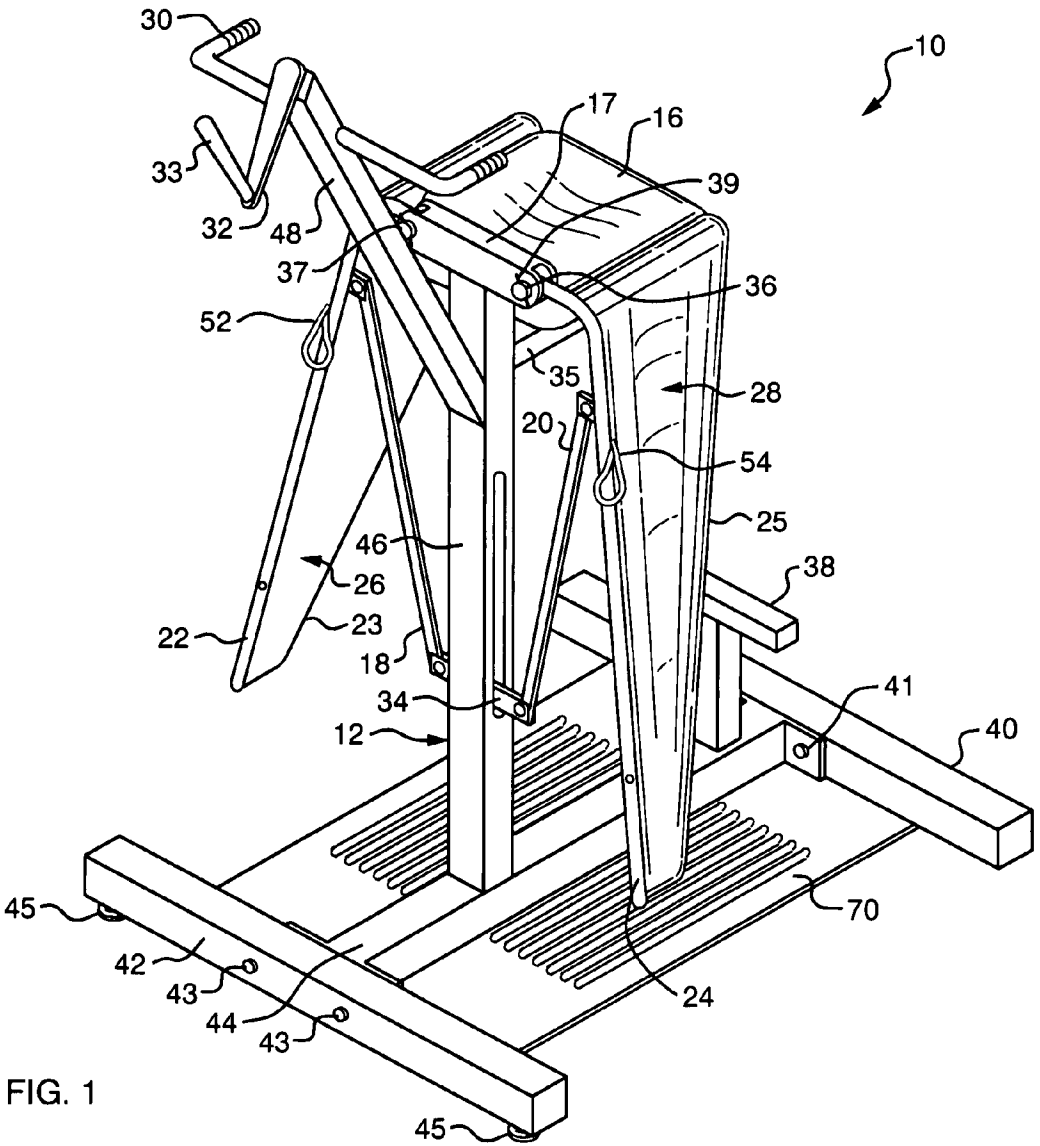
FIG. 1 is a front perspective view of a straddle stretching apparatus in a down or lowered position according to the present invention.
Figure 2:
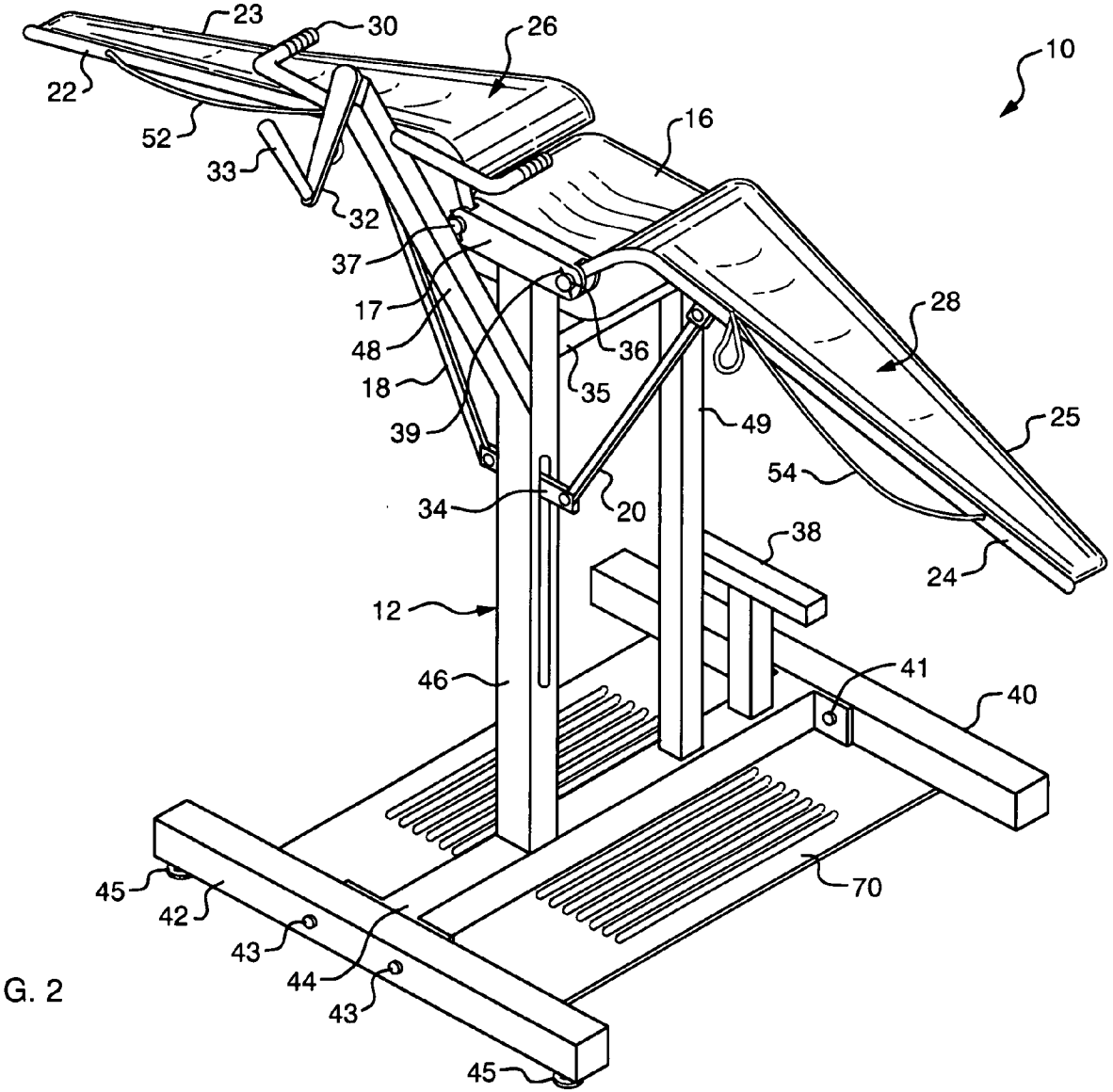
FIG. 2 is a front perspective view of the straddle stretching apparatus in a raised position.

Referring to FIG. 1 and FIG. 2, FIG. 1 is a front perspective view of a straddle stretching apparatus 10 shown in a down or lowered position according to the invention, and FIG. 2 is a front perspective view of the straddle stretching apparatus 10 in a raised position. The straddle stretching apparatus 10 comprises a padded seat 16, mounted on a cross bar 35 of a support frame 12, a step 38 attached to a lower portion of support frame 12 to assist a user climbing on the seat 16, handle bars 30 for providing user stability when getting on and off the apparatus 10 and when exercising on the straddle stretching apparatus 10. First and second leg supporting wings 26, 28 are provided on opposite sides of the seat 16 for raising and lowering the legs of a user in response to the turning of a handle 33 of a crank 32 extending from a crank housing 48. The crank housing 48 extends upward at an angle of approximately 45 degrees from a wing drive housing 46 of the support frame 12.

A hinge support bar 17 is attached to the top of the wing drive housing 46 and in front of the padded seat 16. The first leg supporting wing 26 comprises a first wing support frame 22 attached to one side of a first leg section 23, and the second leg supporting wing 28 comprises a second wing support frame 24 attached to one side of a second leg section 25. The first leg section 23 and the second leg section 25 have concave upper padded surfaces for a user's legs to comfortably rest thereon. An upper end of the first wing support frame 22 attaches to a first end of the hinge support bar 17 by means of a rod 37 inserted therein and held in place by a cotter pin 39. Likewise, an upper end of the second wing support frame 24 attaches to a second end of the hinge support bar 17 by means of a rod 36 inserted therein and held in place by another cotter pin 39. The placement of each of the rods 36, 37 secured by cotter pins 39 provides rotation points when raising and lowering the first leg supporting wing 26 and the second leg supporting wing 28.

Figure 3:
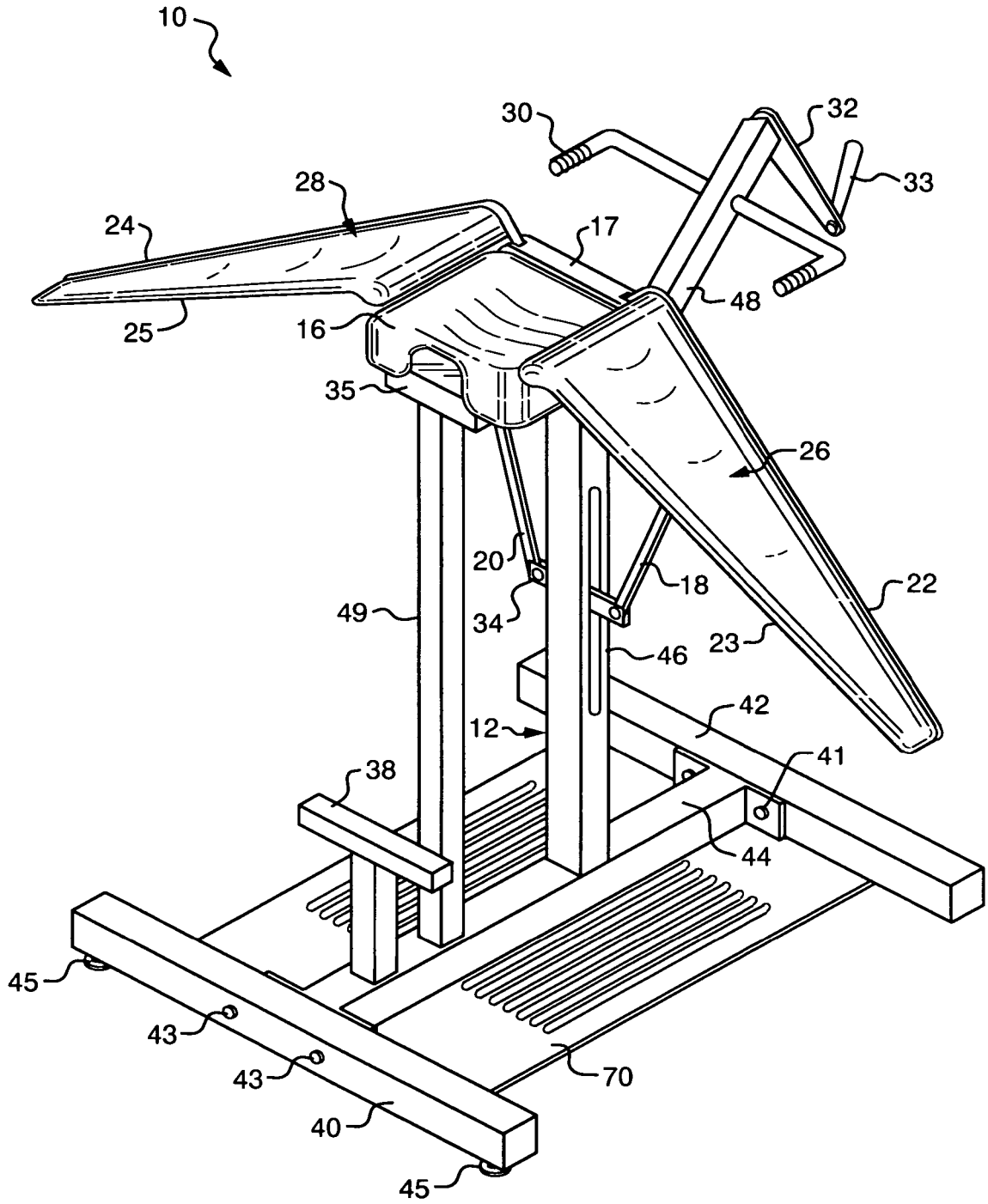
FIG. 3 is a rear perspective view of the straddle stretching apparatus in a partially raised position.

Referring to FIG. 3, a rear perspective view of the straddle stretching apparatus 10 is shown with the first and second leg supporting wings 26, 28 in a partially raised position. The seat 16 having a padded upper surface comprises a cut-out in the rear side for ease of lifting the straddle stretching apparatus 10. The seat 16 mounts on a stud (not shown) protruding from the upper surface of crossbar 35 which is supported by a leg 49. FIG. 3 shows the step 38 for a user to easily climb on the apparatus 10. The handlebars 30 are conveniently located extending from each side of the crank housing 48 for grasping by a user to maintain balance on the stretching apparatus 10. The seat 16 remains stationary while the first and second leg supporting wings 26, 28 are raised or lowered.

Figures 4, 5:
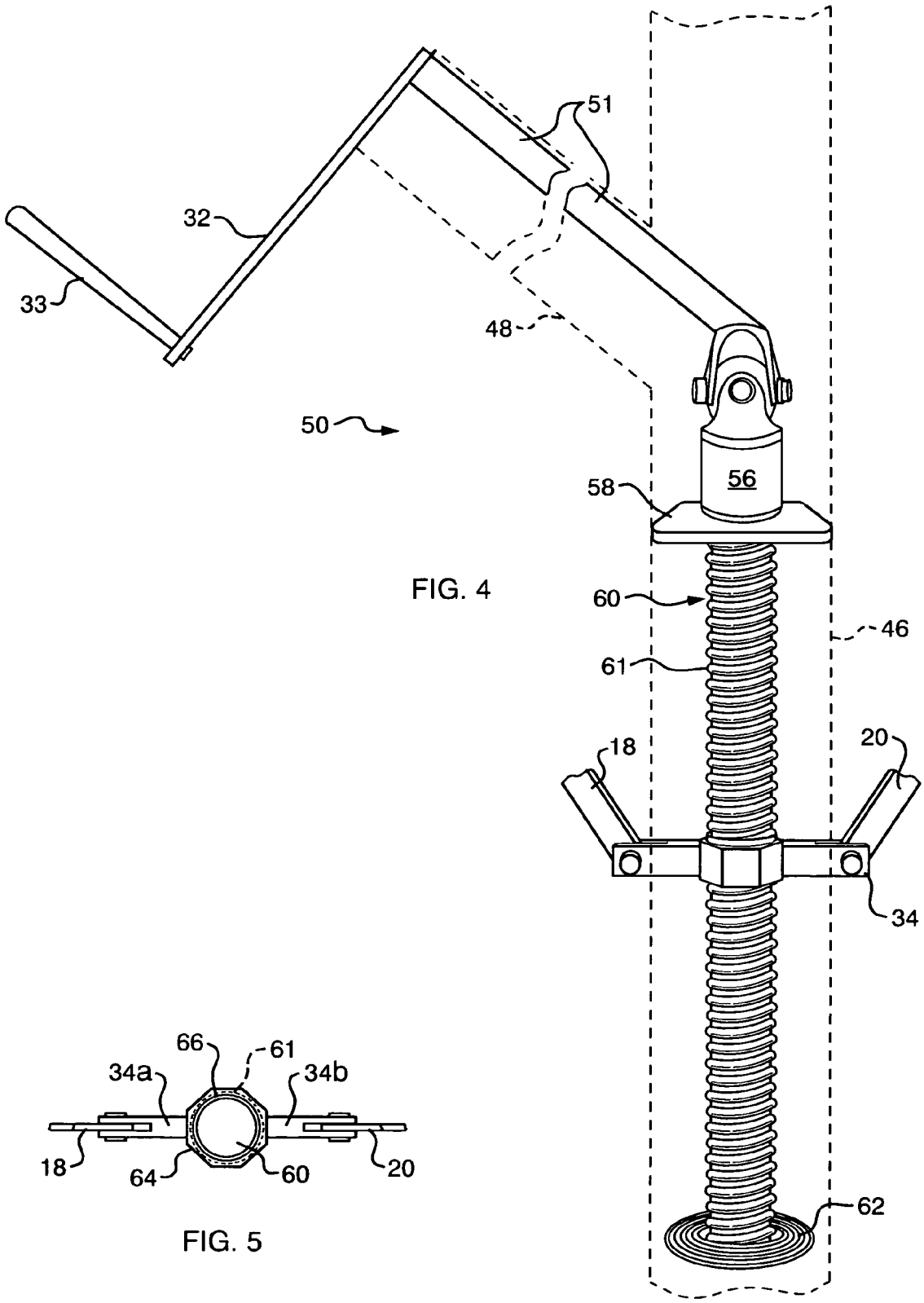
FIG. 4 is a perspective view of the raising and lowering mechanism including a crank and lever attached to a universal joint on the top of a threaded rod with a drive bar positioned thereon for raising or lowering the leg supporting wings.
FIG. 5 is a top view of the threaded rod and drive bar attached to the threaded rod.

Referring to FIG. 1, FIG. 2 and FIG. 4, FIG. 4 is a perspective view of the raising and lowering mechanism 50 of the invention including a crank 32 and crank rod 51. The crank rod 51 is attached to a universal joint 56 mounted on top of an elongated threaded rod 60 which is one inch in diameter with a six pitch. A drive bar 34 is positioned on the threaded rod 60. The crank rod 51 is located within the crank housing 48 and the threaded rod 60 is located within the wing drive housing 46. The crank rod 51 is attached to the top portion of the universal joint 56 by a weld joint. Also, the universal joint 56 attaches to the top of the threaded rod 60 by a weld joint. The upper end of the threaded rod 60 extends through a drive plate 58, and the drive plate 58 attaches to the wing drive housing 46 for providing a secure connection for the top of the threaded rod 60 within the wing drive housing 46. The lower end of the threaded rod 60 is positioned in a thrust bearing 62 to facilitate rotation of the threaded rod 60. The threaded rod 60 may be obtained from ACME® Threaded Products, Inc. of Westbury, N.Y. The thrust bearing 62 may be embodied by Part No. SFR827, manufactured by Dynaroll of San Fernando, Calif. The crank 32 and crank rod 51 may be embodied by standard steel stock. The universal joint 56 may be embodied by Part No. CJ 6440, manufactured by Curtis, of Springfield, Mass.

Still referring to FIG. 1, FIG. 2 and FIG. 4, the crank 32 is rotated when it is desired to raise the first and second leg supporting wings 26, 28. Rotating the crank 32 causes the threaded rod 60 to turn, and as it turns, a hex nut 64 moves up or down on the threaded rod 60. A drive bar 34, which comprises the hex nut 64 in it's center section, has a lower end of a first strut 18 connected to one end of the drive bar 34 or drive extension 34*a* and a lower end of a second strut 20 connected to a second end of the drive bar 34 or drive extension 34*b*. These connections are made by common bolts and nuts. The drive extensions 34*a*, 34*b* (FIG. 5) of the drive bar 34 are welded to opposite sides of the hex nut 64 and are made of steel. The upper end of the first strut 18 connects to the upper portion of the first wing support frame 22 and the upper end of the second strut 20 connects to the upper portion of the second wing support frame 24. The connections are made by common bolts and nuts. Therefore, when the first and second leg supporting wings 26, 28 are in the down position as shown in FIG. 1 and the crank 32 is rotated, the drive bar 34 moves upward along the threaded rod 60 causing the first and second struts 18, 20 to raise the first and second leg supporting wings 26, 28 toward a horizontal position as shown in FIG. 2. Stretch bands 52, 54 are provided on the sides of the first wing support frame 22 and the second wing support frame 24 to assist the user in stretching exercises.

Referring to FIG. 4 and FIG. 5, FIG. 5 is a top view of the threaded rod 60 and the drive bar 34 attached to the threaded rod 60 by hex nut 64. The hex nut 64 is in the center of the drive bar 34, and it screws on to the threads 61 of the threaded rod 60. Opposite ends of the hex nut 64 are welded to drive extensions 34*a*, 34*b* to form the complete drive bar 34. The hex nut 64 comprises a circular rim 66 on an upper surface. The struts 18, 20 attach to the outer ends of the drive bar 34 by commonly available bolt and nut combinations. The hex nut 64 is commonly available, and it has a thread to match and move along the threaded rod 60 when the rod 60 is rotated.

Referring again to FIGS. 1, 2 and 3, the stretching apparatus is assembled by first attaching the first base support 40 and the second base support 42 to the interconnecting bar 44 of the support frame 12 with bolts 41, 43. Next, the first leg supporting wing 26 and the second leg supporting wing 28 are attached to the hinge support bar 17 located on top of the wing drive housing 46. The attachments are made by the rods 36, 37 and cotter pins 39. A base 70 is attached to the bottom of the support frame 12 by self tapping screws. The first and second struts 18, 20 are attached to the first and second wing support frames 22, 24 respectively by commonly available nuts and bolts.

If it is desired to stretch only one leg, either the first strut 18 or the second strut 20 can be easily disconnected from the drive bar 34.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A leg stretching apparatus comprising:

a frame, said frame supporting a seat attached to a top portion of said frame enabling a user's legs to straddle said frame below said seat;

a pair of leg supporting wings, each mounted on opposite sides of said seat to an end of a hinge support bar positioned on said top portion of said frame;

a threaded rod enclosed within said frame for raising and lowering said leg supporting wings in response to a turning of a crank extending from said frame;

a universal joint attached to an upper end of said threaded rod;

said frame comprises a wing drive housing having said universal joint attached to an upper end of said threaded rod enclosed therein;

a drive bar having a hex nut located in the center of said drive bar which screws on said threaded rod; and said drive bar further comprises a pair of drive extensions, each of said drive extensions being welded to opposite sides of said hex nut and extending through an opening in opposite sides of said wing drive housing.

2. The leg stretching apparatus as recited in claim 1 wherein said frame comprises a step for assisting a user climbing onto said apparatus.

3. The leg stretching apparatus as recited in claim 1 wherein each of said leg supporting wings comprises a wing support frame attached to a leg section.

4. The leg stretching apparatus as recited in claim 1 wherein said crank attaches to an upper end of said universal joint for rotating said threaded rod.

5. The leg stretching apparatus as recited in claim 1 wherein said frame comprises a crank housing, extending upwardly from said wing drive housing, said crank housing enclosing a crank rod attached to said crank.

6. The leg apparatus as recited in claim 1 wherein said apparatus comprises:

a first strut having a first end attached to a first end of said drive bar and a second end attached to a first one of said pair of leg supporting wings; and a second strut having a first end attached to a second end of said drive bar and a second end attached to a second one of said pair of leg supporting wings.

7. A leg stretching apparatus comprising:

a frame having a vertical portion attached to a base portion;

a seat attached on top of said vertical portion of said frame enabling a user's legs to straddle said frame below said seat;

a pair of leg supporting wings, hingedly mounted on opposite sides of said seat;

each of said leg supporting wings comprises a wing support frame attached to a leg section;

a hinge support bar positioned on top of a wing drive housing adjacent to said seat on said top vertical portion of said frame for receiving said pair of hingedly mounted leg supporting wings;

a threaded rod positioned within said wing drive housing of said frame having a universal joint attached to an upper end;

a crank rod extended at a predetermined angle from said universal joint between said universal joint and a crank for turning said threaded rod;

a pair of drive bars attached to opposite sides of a hex nut, said hex nut moving along said threaded rod as said threaded rod turns in response to a rotation of said lever to raise and lower said leg supporting wings;

a first strut having a first end attached to an upper portion of a first end of said drive bar and a second end attached to a first one of said pair of leg supporting wings;

a second strut having a first end attached to an upper portion of a second end of said drive bar and a second end attached to a second one of said pair of leg support wings; and said base portion of said frame supports said wing drive housing and a post positioned between said base and said seat on said top portion of said frame.

8. The leg stretching apparatus as recited in claim 7 wherein said frame comprises a step for assisting a user climbing onto said apparatus.

9. The leg stretching apparatus as recited in claim 7 wherein said leg section being slightly concave to retain a user's leg.

10. The leg stretching apparatus as recited in claim 7 wherein each of said leg support wings comprises a stretch strap to assist the user in a stretching exercise.

11. A method of providing a leg stretching apparatus comprising the steps of:

providing a frame, said frame supporting a seat attached to a top portion of said frame to enable a user's legs to straddle said frame below said seat;

mounting on opposite sides of said seat, to an end of a hinge support bar positioned on said top portion of said frame, a pivoting end of a pair of leg supporting wings;

enclosing a threaded rod within said frame for raising and lowering said leg supporting wings in response to a turning of a crank attached to said raising and lowering means;

attaching a universal joint to an upper end of said threaded rod; and attaching a crank rod between said crank and said upper end of said universal joint for rotating said threaded rod when said crank is rotated.

12. The method as recited in claim 11 wherein said step of providing a frame includes the step of providing a step for assisting a user climbing onto said leg stretching apparatus.

13. The method as recited in claim 11 wherein said step of mounting said pair of leg supporting wings includes the step of attaching a leg support frame to a leg section.

14. The method as recited in claim 11 wherein said step of providing said frame comprises the step of providing a wing drive housing having said universal joint attached to an upper end of said threaded rod enclosed therein.

15. The method as recited in claim 14 wherein said step of attaching a universal joint to an upper end of a threaded rod comprises the steps of:

providing said threaded rod with a drive bar having a hex nut located in the center of said drive bar, said hex nut being screwed on said threaded rod; and extending each end of said drive bar through an opening in opposite sides of said wing drive housing.

16. The method as recited in claim 14, wherein said step of providing said frame comprises the step of providing a crank housing, said crank housing extending upwardly from said wing drive housing for enclosing said crank rod.

17. The leg apparatus as recited in claim 15 wherein said method comprises the steps of:

providing a first strut having a first end attached to a first end of said drive bar and a second end attached to a first one of said pair of leg supporting wings; and providing a second strut having a first end attached to a second end of said drive bar and a second end attached to a second one of said pair of leg supporting wings.

* * * * *